United States Patent [19]

Eastman

[11] 4,183,341

[45] Jan. 15, 1980

[54] REMOTELY CONTROLLED STARTING SYSTEM FOR MODEL ENGINES

[76] Inventor: Fred R. Eastman, 133 Cambridge Dr., Irwin, Pa. 15642

[21] Appl. No.: 799,543

[22] Filed: May 23, 1977

[51] Int. Cl.[2] ..... F02N 17/00

[52] U.S. Cl. ..... 123/179 A; 123/179 B; 123/179 H; 123/179 G; 123/DIG. 3; 261/50 A

[58] Field of Search ..... 123/DIG. 3, 179 BG, 123/179 D, 185 D, 119 F, 179 R, 179 G, 179 A, 179 H; 261/DIG. 2, 64 E, 66, 50 R, DIG. 74

[56] References Cited

U.S. PATENT DOCUMENTS

| | | | |
|---|---|---|---|
| 1,819,576 | 8/1931 | Truax | 123/179 BG |
| 2,444,460 | 7/1948 | Moncrief | 123/179 BG |
| 2,524,452 | 10/1950 | Lewis | 74/7 C |
| 2,791,995 | 5/1957 | Dietrich | 261/66 |
| 2,840,067 | 6/1958 | Carlson | 123/145 A |
| 3,530,846 | 9/1970 | Bean et al. | 123/179 BG |
| 3,534,720 | 10/1970 | DuBois | 123/119 F |
| 3,551,686 | 12/1970 | Koehler et al. | 123/179 H |
| 3,784,174 | 1/1974 | Tarnofsky | 261/DIG. 2 |
| 4,075,998 | 2/1978 | Krauss et al. | 123/179 H |

*Primary Examiner*—Charles J. Myhre
*Assistant Examiner*—David D. Reynolds
*Attorney, Agent, or Firm*—Buell, Blenko & Ziesenheim

[57] ABSTRACT

A system for remote control starting of model engines of the internal combustion type, used on model airplanes, automobiles, boats and the like, while stationary, in motion, or in flight. A starting gear or pulley is mounted by a combination roller bearing and one-way clutch directly on a section of the crank shaft of the engine. An electric starting motor drives the gear or pulley for cranking the engine. The motor is energized by power from a battery pack carried on the vehicle via a circuit having a pair of diodes therein, the voltage drop across which serves to energize the glow plug or igniter. A start switch in the motor circuit is activated by a servo device in turn activated by signals received from a radio receiver on the vehicle. The servo device also activates a choke plug for the carburetor air intake, to aid in initial starting of the engine, and a cut-off valve in the fuel line to assist in starting the engine after stalling, while stationary, on the ground or while in motion, as when an airplane is in flight.

8 Claims, 1 Drawing Figure

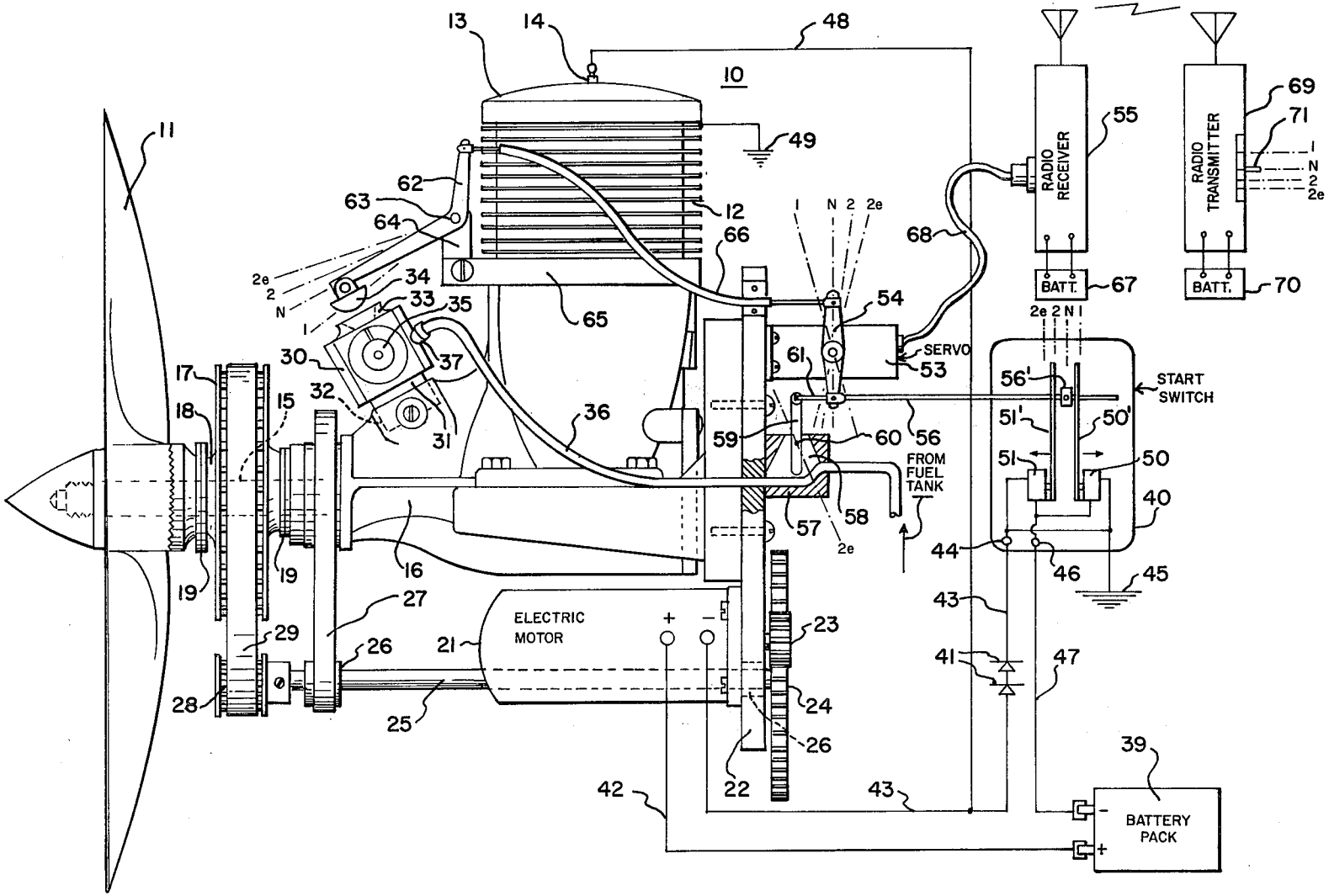
RADIO TRANSMITTER
BATT.
RADIO RECEIVER
BATT.
START SWITCH
BATTERY PACK
SERVO
FROM FUEL TANK
ELECTRIC MOTOR

REMOTELY CONTROLLED STARTING SYSTEM FOR MODEL ENGINES

This invention relates to systems for starting the engines of model airplanes, autos, boats and similar vehicles while on the ground, in flight, or in the water by radio remote control.

In the early days of model engines for propelling model airplanes, autos, and boats the starting of the engine by hand cranking, as by turning the propellor, involved some hazard to the person. Various improved ways of cranking the model engine to start it, without danger or hazard to the person, have therefore been developed. A familiar device is a hand-held, battery powered, motor having a cone-type clutch connector coaxially pressed manually to the hub of the model airplane propeller. Other known ways include a pull cord or loaded spring for cranking the engine through a one-way clutch while supplying voltage from an auxiliary voltage source to the glow plug or igniter.

All existing known forms of present day model engine starters require the model engine or vehicle having the model engine to remain stationary, on the ground or in the case of a boat, at anchor in the water. Where a model airplane engine dies out while the airplane is in flight, present day hand starters are unable to function.

Applicant is aware of a number of patents concerning the subject of starting model engines, of which the following are typical: U.S. Pat. Nos. 2,846,993; 2,855,070; 2,991,779; 3,111,785; 3,159,154 and 3,190,276.

Most if not all of the patents show systems utilizing a one-way clutch through which to apply cranking power to the crank shaft of the engine. Moreover, the voltage for energizing the glow plug or igniter of the engine is necessarily supplied from an external stationary source. I am aware of a hand-held motor starter for model airplane engines which utilizes the voltage drop across a resistor, in the form of two series-connected diodes, in the motor power circuit for energizing the glow plug or igniter. This is disclosed in the December, 1976 issue of the magazine Model Aviation.

Up to the present time, there is no known system of remote control of starting of model engines for airplanes, boats, automobiles and the like vehicles by which to enable starting of the model engine under adverse conditions, such as when a model airplane engine stalls in flight due, for example, to lack of fuel supply to the carburetor or other causes. The primary difficulty or obstacle, up to the present time, to availability of an operative and successful remote controlled starting system lay in the fact that a light-weight motor and battery source of sufficient power to crank the engine was not developed so as to be susceptible of remote control.

I am aware of the fact that there are patents disclosing systems for controlling the starting and operation of automotive vehicles by radio signals from a remote location. The following patents disclose such systems: U.S. Pat. Nos. 3,040,724; 3,577,164; and 3,859,540. As distinguished from the complex systems of these patents, my invention provides a relatively simple, uncomplicated and practical remotely controlled starting system designed especially for internal combustion engines on model vehicles, such as airplanes.

It is accordingly an object of my invention to provide a self-contained starting system for model engines of the type customarily employed in model vehicles, such as airplanes, boats, autos, helicopters and the like, which system is of such light-weight as to enable it to be carried readily on the model plane or other model vehicle while having adequate power for model engine cranking purposes.

It is a further object of my invention to control the starting system of the model engine by radio signals transmitted from a remote location, while the vehicle is stationary or in motion, especially in the case of a model airplane while in flight.

According to my invention I provide a fractional horsepower electric motor which cranks the engine crank shaft through torque-multiplying gearing and a one-way or over-running clutch.

I further provide a servo-actuator in the vehicle, such as an airplane, activated to various functional positions responsively to corresponding signals received from a radio receiver located on the vehicle, which in turn receives the signals as transmitted by radio from a remotely located transmitter.

I further provide a choke plug movable to different positions with respect to the intake port of the carburetor of the model engine, as activated by the servo-actuator, at the same time the servo effects activation of a dual position starting switch in the motor circuit. Moreover, I provide for energization of the igniter or glow plug for the engine, on starting, by a portion of the voltage drop in the motor circuit.

I also provide a cut-off valve, in the fuel line to the carburetor, which is under the control of the servo device for restricting flow of fuel in the fuel line to the carburetor, in the event the model engine stalls, due to carburetor flooding, to insure re-starting of the stalled engine.

The above and other novel aspects of my invention are more fully described hereinafter in connection with a preferred embodiment thereof shown diagrammatically in the accompanying single FIGURE drawing.

Referring to the drawing there is shown a fragmental view of a model engine 10 for driving the propellor 11 of a model airplane (not shown). While engine 10 may be of various types, such as 2-cycle, 4-cycle, Diesel, etc., it is illustratively shown as of the 2-cycle type having a single cylinder 12, at the top of which is a cylinder head 13. Screwed into the cylinder head is a conventional glow-plug or igniter 14 for initiating explosions of fuel mixtures in the cylinder chamber to start the engine. A glow-plug 14 is not required for engines of the Diesel type. As seen in the drawing, a portion of the crank shaft 15 projects in the left-hand direction from the crank case housing 16 and has the propellor 11 attached to the distal end thereof. Interposed between the propellor 11 and the crank case housing 16 is a pulley 17 which is coupled to the crank shaft 15 through a conventional over-running or one-way clutch and bearing element 18. I prefer to use a combined roller bearing and clutch type (Cat. No. RCB 081214) shown in publication 15-1069K of the Torrington Company, Torrington, Conn., although other suitable one-way clutches may be employed. Suitable low-friction washers or thrust bearings 19 are carried on the crank shaft at opposite ends of the clutch and bearing element 18.

While I have shown the pulley as drivingly connected to the crank shaft, it will be understood that to adapt the pulley 17 for attachment to an existing model engine, it may be necessary to first remove the propellor and then screw an extension fitting on the distal end of the crank shaft in order to provide space to accommodate the pulley 17, or replace the existing crank shaft with a new one that is sufficiently long to accommodate the pulley 17.

A fractional horsepower electric motor 21 is mounted on a so-called fire-wall 22 of asbestos or ply-wood sheet, at the rear end of the engine 10, and has a spur gear 23 on its shaft which meshes with a gear wheel 24. Gear wheel 24 is fixed to a shaft 25 which is supported in two suitable spaced bearings 26 respectively carried in the fire-wall 22 and in a support member 27 dependingly attached to the crank case housing of the engine 10. A pulley 28 removably attached, as by a set screw, to the shaft 25 is drivingly connected by a flexible belt 29 to the pulley 17. It will be apparent that inter-engaging gears or gear wheels may be substituted for the pulleys 17 and 28, in which case the flexible belt may be dispensed with. However, I prefer to employ a driving belt, as it lessens the chance of stripping gear teeth on the gears and gear wheels, in the event the engine backfires.

At the forward end of the crank case housing 16 is a carburetor housing 30 of glass-filled Nylon or other plastic material having a cylindrical portion 31 which fits into a bore 32 in the crank case housing. The carburetor housing has an integral funnel-shaped extension 33 providing an entry for air intake into the carburetor. Associated with the funnel-shaped extension 33 is a conical plug 34 of elastomeric material, which functions as a choke plug for the carburetor as hereafter more fully described. An adjusting screw 35 extending through the side wall of the carburetor housing into the fuel mixing chamber within the housing serves to control the feed of fuel into the fuel mixing chamber from a fuel line 36. Fuel line 36 is a flexible hose attached to a nipple 37 screwed into a port through the carburetor housing wall.

A conventional rotary throttle valve (not shown) is provided within the carburetor housing for controlling the air intake into the carburetor and correspondingly the fuel mixture. Details of the throttle valve are omitted for simplication.

My engine starting system further comprises a battery pack 39, made up of a plurality of separate cells of the nickle cadmium type, providing suitable voltage, such as 12 volts, and ampere-hour capacity. Electric motor 21 is connected to the battery pack 39 via circuitry including a dual-position start switch device 40 (hereafter described) and one or more, illustratively shown as two, series-connected diodes 41. As shown, one terminal of the motor is connected directly to the positive (+) terminal of the battery pack by a wire 42. Diodes 41 are interposed in a wire 43 that extends between the other terminal of the motor and one terminal 44 of the switch device 40. Terminal 44 of the switch device 40 is connected to ground at 45. The other terminal 46 of switch device 40 is connected to the negative (−) terminal of the battery pack by a wire 47. One terminal of glow-plug 14 is connected by a wire 48 to the terminal of the one of the two diodes 41 which is connected by wire 43 to the motor 21. The other terminal of the glow-plug 14 is connected to ground at 49, since it contacts the metallic cylinder head 13. It will be seen, therefore that, on closure of switch device 40, glow-plug 14 is energized by the voltage-drop across the diodes 41, which is only a part of the total voltage in the motor circuit. If desired, glow-plug 14 may be energized from a separate voltage source under control of the starting switch 40.

Switch device 40 comprises two microswitches 50 and 51 the opposite terminals of which are connected to terminals 44 and 46 respectively. Each microswitch 50 and 51 has a projecting plunger which is depressed, to close the microswitch by lateral flexure of a corresponding flexible finger 50' and 51' anchored at one end.

Fingers 50' and 51' are flexed in opposite directions indicated by the arrows, to cause selective closure of microswitches 50 and 51, by means of an actuator such as a conventional servo device 53. Servo device 53 is conveniently mounted, as for example, to the fire-wall 22, and has an arm 54 fixed to a rotary shaft which is activated selectively to functional positions responsively to signals from a conventional radio receiver 55. As shown, the arm 54 on the rotary shaft is shifted angularly to opposite sides of a neutral position indicated by the letter N. Arm 54 has a first functional position, indicated by the numeral 1, which is counterclockwise from the neutral position. Arm 54 also has two spaced functional positions located clockwise of the neutral position and indicated by the numerals 2 and 2*e*, respectively.

Arm 54 is arranged to flex the fingers 50' and 51' of the switch device 40 by means of a rod or rigid wire 56, connected pivotally, as by a clevis, to the lower end of arm 54 and extending through holes or slots in the fingers 50' and 51'. A collar 56' is adjustably secured to rod 56, as by a set screw, at a point between the two fingers.

It will be apparent that when the arm 54 is activated counterclockwise to position 1, collar 56' is correspondingly shifted in the right-hand direction to pick-up and flex the finger 50' to the right to close microswitch 50. Similarly, when the arm 54 is activated clockwise to position 2, collar 56 is shifted to the left to pick-up and flex finger 51' to close microswitch 51. Activation of arm 54 further to position 2*e* causes activation of a cut-off valve 57, controlling flow of fuel through fuel line 36, for a purpose later explained. As seen, valve 57 comprises a valve body having a chamber 58 through which the fuel line 36 extends. A lever 59 is pivoted on a pin 60 to the valve body within the chamber 58 with one arm projecting exteriorly and connected by a rod or wire 61 to the lower end of arm 54 of servo device 53. The floor of the chamber 58 is of such configuration that in the position 2*e* of the arm 54 of servo device 53, the arc of movement of the lower arm of lever 59 of valve 57 causes the end of the lever to pinch the fuel line to restrict flow of fuel therethrough. Upon movement of lever 59 in the opposite direction, responsively to counterclockwise movement of arm 54 of servo device 53 to position 1, the arc of movement of the lower end of lever 59 is such as to clear the fuel line without pinching it.

Servo device 53 also activates the choke plug 34 associated with the carburetor 30. As shown, plug 34 is fixedly carried, as by a clevis and pin, on the end of one arm of bell-crank lever 62. Lever 62 is pivotally mounted as by a pin 63 at the knee thereof, to a bracket 64 attached, as by a clamp 65, to the engine cylinder 12. The other arm of the bell-crank lever 62 is connected by a flexible shaft or Bowden wire 66 to the upper end of arm 54 of the servo device 53, with the outer sleeve of the wire suitably anchored as in the fire-wall 22.

Plug 34 is activated to different functional positions relative to the carburetor intake funnel 33, in correspondence with angular movement of arm 54 of the servo device 53. Thus, in the position 1 of arm 54 of servo device 53, plug 34 is activated to its position 1, in which it restricts or even closes off the air intake to the carburetor through the funnel 33.

In the positions 2 and 2*e* of arm 54 of servo device 53, plug 34 is correspondingly raised out of its neutral position N to its positions 2 and 2*e* respectively, in both of which positions the air intake to the carburetor is maximum.

It will be understood that associated with the radio signal receiver 55 is a suitable battery 67 which may also supply electrical energy for operating the servo device 53. A cable 68, made up of a bundle of conducting wires, connects the receiver 55 to the servo device 53 for supplying battery power to the servo device 53 and transmitting signals thereto corresponding to the radio signals received by the receiver 55.

For the purposes of transmitting radio signals to the receiver 55 from a remote location, while the airplane or other vehicle is on the ground, or in motion on the ground or in the air, a radio transmitter 69 is provided. Transmitter 69 is provided with conventional equipment and operating controls for transmitting control signals to servo devices (not shown) on the plane (or other vehicle) for flight or motion control. A suitable battery 70 is also connected thereto. According to my invention, I also provide transmitter 69 with a control lever 71 which is shiftable to different control positions. For simplicity I have shown lever 71 as shiftable linearly in opposite directions from a neutral position N to a position 1, to one side of neutral, and successively to positions 2 and 2*e* on the opposite side of neutral. It will be understood that the radio signals transmitted by transmitter 69 to receiver 55 in each of the positions of the control lever 71 are such as to activate arm 54 of servo device 53 to corresponding positions.

In operation, let it be assumed that the vehicle being considered is a model airplane equipped with a model engine and starting control as heretofore described. Since the flight controls of the airplane form no part of this invention, the following description of operation will be confined to the starting system for the engine.

To start the engine, the operator shifts the lever 71 of transmitter 69 out of neutral position N to position 1 momentarily and then back to position 2. In response to the signal transmitted to receiver 55 in the position 1 of lever 71, the arm 54 of servo device 53 shifts correspondingly to its position 1. Such movement of arm 54 produces corresponding movement of bell-crank 62, via flexible shaft 66, to its position 1, in which choke plug 34 is in its choking position. At the same time, arm 54 of servo device 53 activates microswitch 50 to its closed position, thereby establishing the energizing circuit for motor 21 from the positive terminal of battery pack 39, via the diodes 41 and microswitch 50 to the negative battery terminal. While thus energized, motor 21 turns the engine crank shaft through the gears 23 and 24, pulley 28, belt 29, and pulley 17, and via over-running clutch 18. As the crank shaft turns, fuel is initially drawn into the carburetor chamber together with air, to the extent permitted by plug 34.

After a momentary cranking of the engine as just described, lever 71 is shifted back through neutral position N to position 2, wherein the signal transmitted to receiver 55 is such as to shift arm 54 of the servo device to its position 2. Such movement of the arm 54 causes the microswitch 50 to return to open position and almost immediately causes microswitch 51 to be closed, thereby reclosing the energizing circuit for starting motor 21 after a momentary interruption. With the starting motor circuit completed as just described, the voltage drop across the diodes 41 causes energization of the glow-plug 14. With the proper fuel mixture established in the carburetor and crank case chambers, the mixture is fired to cause rotation of the crank shaft. Thereafter, the throttle valve of the carburetor may be controlled by remote control from transmitter 69, in conventional manner, to control the speed of the engine. It will be understood that once the idling speed of the crank shaft is attained, the driving connection to the crank shaft via the over-running clutch is broken or interrupted and the lever 71 of the transmitter 69 should be restored immediately to its neutral position N, wherein the servo device 53 restores the microswitch 51 to open position. In conventional manner, the glow-plug 14 continues to function, notwithstanding interruption of the energizing circuit for starting motor 21, by reason of the fact that it remains heated due to internal combustion within the engine cylinder 12.

Let it now be assumed that, after the airplane has attained flight condition, for some reason the engine stalls. In this situation my starting system is uniquely advantageous, for the reason that it is adapted for cranking the engine while in flight. To start the engine under this condition while in flight, the same operation of lever 71 of transmitter 69 is performed, as before described, that is, it is shifted successively to positions 1 and 2.

If while the airplane is on the ground, the engine stalls, due to flooding, the engine may be started by similar operation of lever 71 except that when the lever 71 is shifted back through neutral position from position 1, it is moved through position 2 to position 2*e*.

In this position of lever 71, the arm 54 of servo device 53 rocks to position 2*e* in which the lever 59 of cut-off valve 57 pinches the wall of fuel line 36, thereby restricting the supply of fuel to the carburetor mixing chamber. At the same time, in the position 2*e* of arm 54 of servo device 53, the bell-crank lever 62 shifts the choke plug 34 correspondingly to its position 2*e*, in which maximum air intake into the carburetor occurs. With such restriction of fuel feed and maximum air intake the fuel mixture in the cylinder 12 returns promptly to proper firing mix for immediate starting of the engine. If the engine does not start immediately, the lever 71 should be restored to its neutral position N for a moment and then operated again or repeatedly until the engine does start. Once the engine starts the lever 71 of the transmitter should be restored to its neutral position N; following which the normal throttle control of the carburetor is restored.

While I have described my engine starting system in connection with a model airplane, it should be understood that the system may, with little or no modification, be applied to various other model vehicles such as model automobiles, model boats, and model helicopters, as well as to propellor drive reduction units and ducted fan devices. Moreover, various modifications may be made in location or arrangement of the parts of the system within the terms of the appended claims. Thus, while I have shown the starting drive connection as made to the forward end of the crank shaft, my invention may be utilized equally well with a starting drive connection at the rear end of the crank shaft.

I claim:

1. In a starting system for internal combustion engines for model vehicles of the type including airplanes, helicopters, autos and boats, in which the engines have a chamber and a power responsive element operating therein, a carburetor having a fuel supply line and an air intake which carburetor supplies a combustible fuel-air mixture to said engine chamber, the improvement comprising an electric starting motor on the vehicle, a torque-amplifying drive mechanism including an overrunning clutch by which said motor drives said element to start the engine, a battery on the vehicle, an energizing circuit connecting said battery to said motor and including a starting switch device movable between a first position effective to cause operation of said motor to crank said element and a second position to terminate operation of the motor, a glow plug for firing a fuel-air mixture in said engine, means providing a voltage drop substantially equal to the voltage drop in said glow plug in said energizing circuit in parallel with said glow plug, and an actuator having a neutral position and being actuable out of said neutral position to effect closure of said starting switch.

2. In a starting system for internal combustion engines for model vehicles of the type including airplanes, helicopters, autos and boats, in which the engines have a cylinder and crank case and a piston and crank shaft assembly operating therein, a carburetor having a fuel supply line and an air intake which carburetor supplies a combustible fuel-air mixture to said engine cylinder, and a glow-plug for firing the fuel mixture in the cylinder, the improvement comprising an electric starting motor on the vehicle, a torque-amplifying drive mechanism including an over-running clutch by which said motor drives said crank shaft to start the engine, a battery on the vehicle, an energizing circuit connecting said battery to said motor and including in parallel a glow plug and voltage drop means providing a voltage drop substantially equal to the voltage drop in said glow plug and a normally open starting switch device effective when closed to cause energization of said glow plug and operation of said motor to crank said crank shaft assembly, a choke member for controlling the air intake into said carburetor and an actuator having a neutral position and being actuable out of said neutral position to effect simultaneously the closure of said starting switch and the movement of said choke member to restrict the amount of air intake to said carburetor.

3. In a starting system for internal combustion engines for model vehicles of the type including airplanes, helicopters, autos and boats, in which the engines have a chamber and a power responsive element operating therein, a carburetor having a fuel supply line and an air intake which carburetor supplies a combustible fuel-air mixture to said engine chamber, the improvement comprising an electric starting motor on the vehicle, a torque-amplifying drive mechanism including an overrunning clutch by which said motor drives said element to start the engine, a battery on the vehicle, an energizing circuit connecting said battery to said motor and including a normally open starting switch device effective when closed to cause operation of said motor to crank said element, a choke member for controlling the air intake into said carburetor, and an actuator having a neutral position and being actuable out of said neutral position to effect simultaneously the closure of said starting switch and the movement of said choke member to restrict the amount of air intake to said carburetor, wherein a cut-off valve is provided for restricting the flow of fuel through said fuel supply line to said carburetor, and wherein said actuator is actuable to a position in which it causes said cut-off valve to restrict flow of fuel through the fuel supply line to said carburetor while effecting closure of said starting switch device.

4. In a starting system for internal combustion engines for model vehicles of the type including airplanes, helicopters, autos and boats, in which the engines have a chamber and a power responsive element operating therein, a carburetor having a fuel supply line and an air intake which carburetor supplies a combustible fuel-air mixture to said engine chamber, the improvement comprising an electric starting motor on the vehicle, a torque-amplifying drive mechanism including an overrunning clutch by which said motor drives said element to start the engine, a battery on the vehicle, an energizing circuit connecting said battery to said motor and including a normally open starting switch device effective when closed to cause operation of said motor to crank said element, a choke member for controlling the air intake into said carburetor, and an actuator having a neutral position and being actuable out of said neutral position to effect simultaneously the closure of said starting switch and the movement of said choke member to restrict the amount of air intake to said carburetor, wherein said actuator is actuable out of said neutral position in one direction to a first starting position and in the reverse direction out of said neutral position to a second starting position, and wherein said starting switch device comprises two parallel connected switches, one of which is activated to its circuit-closing position responsively to actuation of said actuator to its first starting position, and the other of which is activated to its circuit-closing position responsively to actuation of said actuator to its second starting position, said actuator being effective to cause movement of said choke member to restrict the amount of air intake to said carburetor when shifted to its first starting position and movement of said choke member to a position of full air intake to the carburetor when shifted to its second starting position.

5. In a starting system for internal combustion engines for model vehicles according to claim 1, the further improvement comprising a radio receiver on the vehicle which controls actuation of said actuator to a different one of a plurality of positions in correspondence with the control signal transmitted thereto, and a radio transmitter disposed at a location remote from the vehicle and operative to transmit signals to said receiver.

6. In a starting system for internal combustion engines for model vehicles according to claim 2, and further characterized in that said energizing circuit for said motor includes at least one diode in the means providing a voltage drop in parallel with said glow-plug.

7. In a starting system for internal combustion engines for model vehicles of the type including airplanes, helicopters, autos and boats, in which the engines have a chamber and a power responsive element operating therein, a carburetor having a fuel supply line and an air intake which carburetor supplies a combustible fuel-air mixture to said engine chamber, the improvement comprising an electric starting motor on the vehicle, a torque-amplifying drive mechanism including an overrunning clutch by which said motor drives said element to start the engine, a battery on the vehicle, an energizing circuit connecting said battery to said motor and including a normally open starting switch device effective when closed to cause operation of said motor to crank said element, a choke member for controlling the air intake into said carburetor, and an actuator having a neutral position and being actuable out of said neutral position to effect simultaneously the closure of said starting switch and the movement of said choke member to restrict the amount of air intake to said carburetor, wherein said actuator is actuable out of said neutral position in one direction to a first starting position and in the reverse direction out of said neutral position in succession to a second starting position and an extended position, wherein said starting switch device comprises two parallel-connected switches, one of which is activated to its circuit-closing position responsively to actuation of said actuator to its first starting position and the other of which is activated to its circuit-closing position responsively to actuation of said actuator to its second starting position, wherein a cut-off valve is provided for restricting the flow of fuel through said fuel supply line to said carburetor, and wherein said actuator is effective in its extended position to operate the other of said switches to its circuit-closing position and also said cut-off valve from a non-flow restricting position to its fuel flow restricting position.

8. In a remotely controlled starting system for internal combustion engines for vehicles of the type including model airplanes, helicopters, autos and boats, in which the engines have a cylinder and crank case and a piston and crank shaft assembly operating therein, a carburetor having a fuel supply line and an air intake, which carburetor supplies a combustible fuel-air mixture to said engine cylinder, and a glow-plug for firing the fuel mixture in the cylinder, the improvement comprising an electric starting motor on the vehicle, a torque-amplifying drive mechanism including an overrunning clutch by which said motor drives said crank shaft to start the engine, a battery on the vehicle, an energizing circuit connecting said battery to said motor and including a switch device having two parallel-connected normally open switches, each of which is effective when closed to complete said circuit to effect operation of said motor to crank said crank shaft assembly and to cause firing of said flow-plug, a choke member for restricting the air intake into said carburetor, and a cut-off valve for restricting flow of fuel through said fuel supply line to said carburetor, an actuator having a neutral position and being actuable out of the neutral position in one direction to a first starting position and in the reverse direction out of said neutral position in succession to a second starting position and an extended position, said actuator being effective in its first starting position to operate one of said switches to its circuit-closing position to start said motor and concurrently move said choke member to its air intake restricting position from a non-restricting position, and effective in its second starting position to operate the other one of said switches to its circuit-closing position to cause operation of said motor and concurrently to activate the choke member to its non-restricting position, and also effective in its extended position to operate the other one of said switches to its circuit-closing position to operate said motor, cause movement of said choke member to its full non-restricting position, and operate said cut-off valve to a fuel flow restricting position; a radio receiver on the vehicle which controls actuation of said actuator to its said different positions according to radio signals received thereby; and a radio transmitter disposed at a location remote from the vehicle operative to transmit signals to said receiver.

* * * * *

UNITED STATES PATENT AND TRADEMARK OFFICE

CERTIFICATE OF CORRECTION

PATENT NO. : 4,183,341

DATED : January 15, 1980

INVENTOR(S) : FRED R. EASTMAN

It is certified that error appears in the above-identified patent and that said Letters Patent are hereby corrected as shown below:

Claim 8, column 10, line 8, "flow-plug" should read --glow-plug--.

Signed and Sealed this

*Twenty-second* Day of *July 1980*

[SEAL]

*Attest:*

SIDNEY A. DIAMOND

*Attesting Officer*

*Commissioner of Patents and Trademarks*